US006007405A

United States Patent [19]

Mei

[11] Patent Number: 6,007,405

[45] Date of Patent: Dec. 28, 1999

[54] METHOD AND APPARATUS FOR ENDPOINT DETECTION FOR CHEMICAL MECHANICAL POLISHING USING ELECTRICAL LAPPING

[75] Inventor: Len Mei, Hsinchu, Taiwan

[73] Assignee: ProMOS Technologies, Inc., Hsinchu, Taiwan

[21] Appl. No.: 09/118,171

[22] Filed: Jul. 17, 1998

[51] Int. Cl.[6] ..... B24B 249/00

[52] U.S. Cl. ..... 451/5; 451/8; 451/9; 451/288; 451/398; 438/692

[58] Field of Search ..... 451/8, 9, 288, 451/398; 438/691, 692; 156/345

[56] References Cited

U.S. PATENT DOCUMENTS

| | | | |
|---|---|---|---|
| 4,792,895 | 12/1988 | Kaanta et al. | 156/627 |
| 5,132,617 | 7/1992 | Leach et al. | 324/207 |
| 5,245,794 | 9/1993 | Salugsugan | 451/10 |
| 5,337,015 | 8/1994 | Lustig et al. | 324/671 |
| 5,643,048 | 7/1997 | Iyer | 451/6 |
| 5,816,895 | 10/1998 | Honda | 451/41 |
| 5,836,805 | 11/1998 | Obeng | 451/36 |
| 5,882,243 | 3/1999 | Das et al. | 451/5 |
| 5,916,009 | 6/1999 | Izumi et al. | 451/5 |

*Primary Examiner*—David A. Scherbel
*Assistant Examiner*—Shantese McDonald
*Attorney, Agent, or Firm*—Blakely Sokoloff Taylor & Zafman

[57] ABSTRACT

A chemical mechanical polisher for polishing a surface of a semiconductor wafer is disclosed. The polisher comprises: a polishing table for holding a polishing pad; a rotatable wafer chuck for holding said semiconductor wafer against said polishing pad; an electrical lapping guide secured to said wafer chuck, said electrical lapping guide comprising: a polishable resistive sensor that has a variable resistance dependent upon the amount of material removed from said resistive sensor during polishing; and a bias means for applying a bias to said resistive sensor such that said resistive sensor is in contact with said polishing pad during polishing; a resistance sensing means for determining said variable resistance of said resistive sensor; and a microprocessor for determining the amount of material polished from said resistive sensor based upon said variable resistance.

21 Claims, 3 Drawing Sheets

METHOD AND APPARATUS FOR ENDPOINT DETECTION FOR CHEMICAL MECHANICAL POLISHING USING ELECTRICAL LAPPING

FIELD OF THE INVENTION

The present invention relates to chemical mechanical polishing (CMP), and more particularly, to endpoint detection during a CMP process.

BACKGROUND OF THE INVENTION

Chemical mechanical polishing (CMP) has emerged as a crucial semiconductor technology, particularly for devices with critical dimensions smaller than 0.3 microns. One important aspect of CMP control is endpoint detection (EPD), i.e., determining when to terminate the polishing during the polishing process. The EPD systems are, in principle, in-situ EPD systems, which provide endpoint detection during the polishing process.

One class of prior art in-situ EPD techniques involve the electrical measurement of changes in the capacitance, the impedance, or the conductance of the test structure on the wafer and calculating the end point based on an analysis of this data.

Another electrical approach which has proven production worthy is to sense changes in the friction between the wafer being polished and the polish pad. Sensing changes in the motor current does such measurements. This method is only reliable for EPD for metal CMP because of the dissimilar coefficient between the polish pad and the tungsten-titanium nitride-titanium film stack versus the polish pad and the oxide underneath the metal. However, with advanced interconnection conductors such as polysilicon, oxide, copper, and barrier metals, e.g. tantalum or tantalum nitride, have a coefficient of friction similar to the underlying oxide. This approach relies on detecting the Cu-tantalum nitride transition, then adding an overpolish time. Intrinsic process variations in the thickness and composition of the remaining interfacial layer mean that the final endpoint trigger time is less precise than is desirable.

Another method uses an acoustic approach. In the first acoustic approach, an acoustic transducer generates an acoustic signal which propagates through the surface layer (s) of the wafer being polished. Some reflection occurs at the interface between the layers, and a sensor positioned to detect the reflected signals can be used to determine the thickness of the topmost layer as it is polished. The second acoustic approach is to use an acoustical sensor to detect the acoustical signals generated during CMP. Such signals have spectral and amplitude content which evolves during the course of the polish cycle. However, to date there has been no commercially available in situ endpoint detection system using acoustic methods to determine endpoint.

Finally, optical EPD systems as exemplified by U.S. Pat. No. 5,433,651 to Lustig et al. sense changes in a reflected optical signal using a window in the platen of a rotating CMP tool. However, the window complicates the CMP process because it presents to the wafer an inhomogeneity in the polish pad. Such a region can also accumulate slurry and polish debris.

U.S. Pat. No. 5,413,941 discloses a method in which the wafer is lifted off of the pad a small amount, and a light beam is directed between the wafer and the slurry coated pad. The light beam is incident at a small angle so that multiple reflections occur. The irregular topography on the wafer causes scattering, but if sufficient polishing is done prior to raising the carrier, then the wafer surface will be essentially flat and there will be very little scattering due to the topography on the wafer. The difficulty with this approach is that one must interrupt the normal process cycle to make the measurement.

U.S. Pat. No. 5,643,046 describes the use of monitoring absorption of particular wavelengths in the infrared spectrum of a beam that passes through a wafer being polished. Changes in the absorption within narrow, well defined spectral windows correspond to changing thickness of specific types of films.

Each of these above methods have drawbacks. What is needed is a new method for endpoint detection that is capable of operation in the manufacturing environment.

SUMMARY OF THE INVENTION

A new chemical mechanical polisher using an electrical lapping guide for polishing a surface of a semiconductor wafer is disclosed. The polisher comprises: a polishing table for holding a polishing pad; a rotatable wafer chuck for holding said semiconductor wafer against said polishing pad; an electrical lapping guide secured to said wafer chuck; and a microprocessor which converts the lapping rate to a normalized value. The electrical lapping guide comprises a polishable resistive sensor and a bias means. The polishable resistive sensor has a variable resistance dependent upon the amount of material removed from said resistive sensor during polishing. The bias means applies a bias to said resistive sensor such that said resistive sensor is in contact with said polishing pad during polishing. The apparatus also includes a resistance sensing means for determining said variable resistance of said resistive sensor.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention relates to a method of EPD using an electrical lapping guide that is secured to the wafer carrier. CMP machines typically include a means of holding a wafer or substrate to be polished (also referred to as a "wafer chuck"), a polishing pad, and a means to support the pad (also referred to as a "platen"). Slurry is required for polishing and is delivered either directly to the surface of the pad or through holes and grooves in the pad directly to the surface of the wafer. The control system on the CMP machine causes motors to press the surface of the wafer against the pad surface with a prescribed amount of force. The motion of the wafer is arbitrary, but is typically rotational in the preferred embodiment. Further, preferably, the motion of the polishing pad is either rotational or orbital. Further, it is to be understood that other elements of the CMP tool not specifically shown or described may take various forms known to persons of ordinary skill in the art.

Figure 1:
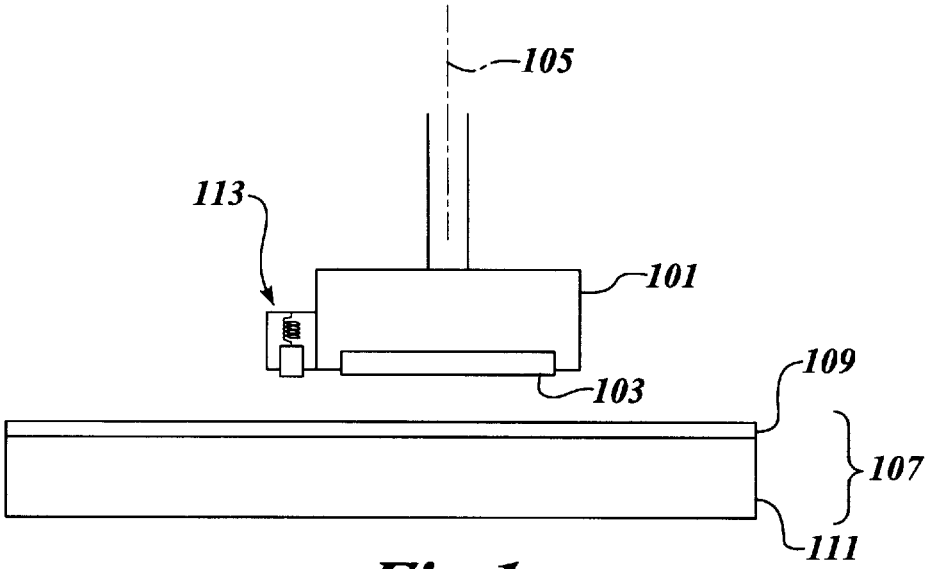
FIG. 1 is a schematic illustration of a CMP apparatus formed in accordance with the present invention.

A schematic representation of the overall system of the present invention is shown in FIG. 1. As seen, a wafer chuck 101 holds a wafer 103 that is to be polished. The wafer chuck 101 preferably rotates about its vertical axis 105. A pad assembly 107 includes a polishing pad 109 mounted onto a polishing table 111. The polishing table is secured to a driver or motor means (not shown) that is operative to move the pad assembly 107 is the desired manner. Those of ordinary skill in the art will recognize that the foregoing structure is known in the prior art and is commonly used by the majority of current CMP machines.

However, in contrast to the prior art, an electrical lapping guide (ELG) 113 is provided for attachment to the periphery of the wafer chuck 101. The attachment to the wafer chuck 101 may be made by any conventional means, for example, adhesive or mechanical screws. Further, it can be appreciated that multiple ELGs may be placed along the periphery of the wafer chuck 101 to enable robust operation. Specifically, multiple ELGs 113 may be used to allow confirmation of the amount of material removed during polishing and also to provide a measure of the uniformity of polishing.

Figure 2:
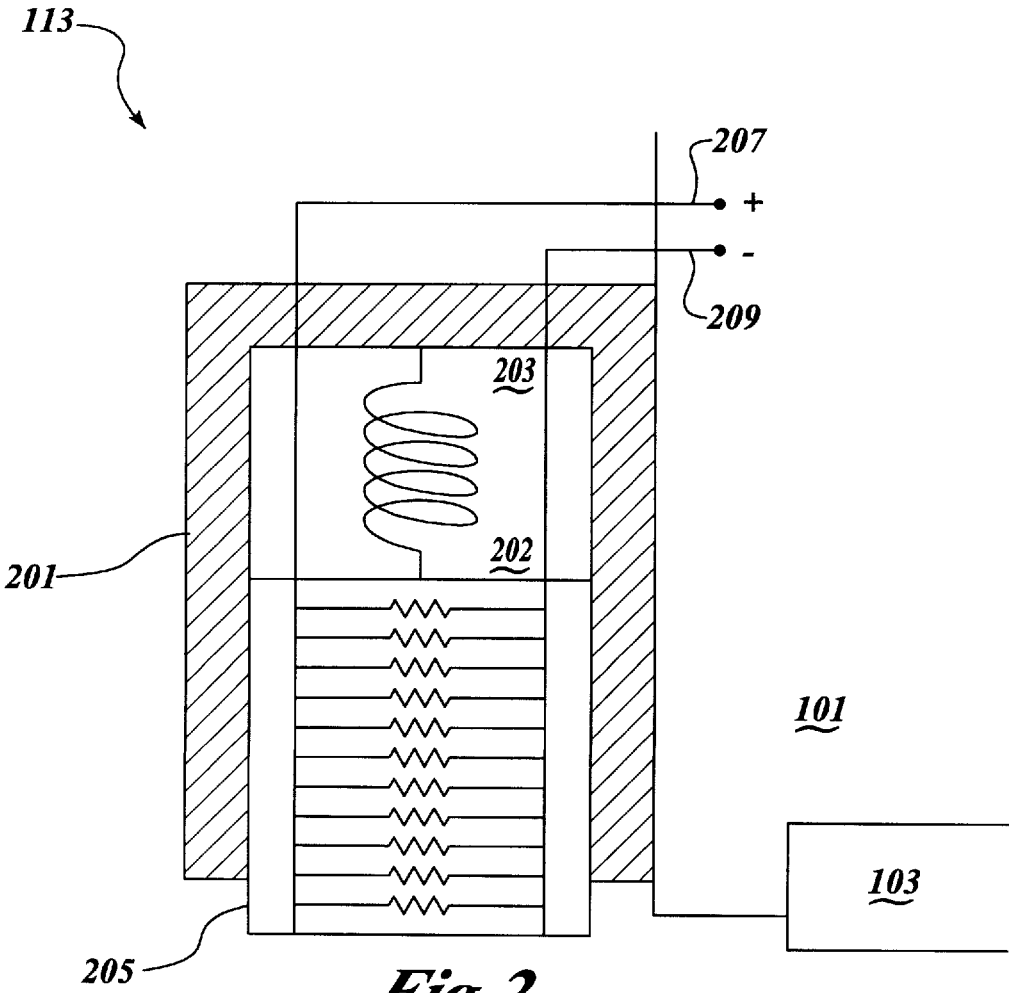
FIG. 2 is a schematic diagram of the electrical lapping guide formed in accordance with the present invention.

FIG. 2 is a more detailed illustration of the ELG 113. As seen, the ELG 113 includes a body 201, a spring 203, and a resistive sensor 205. The body 201 is preferably of cylindrical shape having an open cavity 202 facing downwardly towards the polishing pad 109. As noted above, the body 201 is fixedly attached to the wafer chuck 101 and therefore moves as the wafer chuck 101 moves. Although in the preferred embodiment the body 201 is cylindrical, the body 201 may be formed into any one of a number of shapes. The only criteria is that the body 201 must be suitable for convenient attachment to the wafer chuck 101 and be adapted to receive spring 203 and resistive sensor 205. One alternative shape would be for the body 201 to be rectangular or square.

Preferably, the resistive sensor 205 is adapted to fit within open cavity 202 and slide longitudinally downwards within the open cavity 202. The resistive sensor 205 (described further below) is preferably formed from a silicon substrate with an array of parallel resistors formed from polysilicon.

The spring 203 is secured to the back surface of the open cavity and one end of the resistive sensor 205. The spring 203 is operative to exert a downward bias on the resistive sensor 205. In this manner, the resistive sensor 205 will be in contact with the polishing pad 109 at the same time the wafer 103 is in contact with the polishing pad. It can be appreciated that the spring 203 may be substituted therefore by any one of a number of equivalent biasing mechanisms from as simple as a weight to as complicated as a variable pressure hydraulic mechanism. Optimally, it would be preferable for the spring 203 to be replaced by a variable hydraulic system that can provide an adjustable downward pressure on the resistive sensor 205.

Nevertheless, even if the spring 203 is used, using known relationships between applied pressure and polish rate, the amount of pressure provided by the spring 203 may be "normalized" to the pressure applied to the wafer. In such a manner, the polish rates can also be normalized to each other.

Specifically, the four primary factors that are used to relate the polish rate of the resistive sensor 205 to the polish rate of the wafer are: (1) the pressure applied by the spring 203 to the resistive sensor denoted $P_1$; (2) the pressure applied by the wafer chuck to the wafer denoted $P_2$ (known as "backside pressure"); (3) the material of the resistive sensor 205; and (4) the material to be polished from the wafer (typically oxide, polysilicon, or tungsten).

It has been determined that generally the polish rate for most materials varies linearly as the pressure varies. Therefore, assuming that both the wafer material to be polished and the material of the resistive sensor 205 is the same, then the polish rate for both the resistive sensor and the wafer can be easily determined based upon the pressure applied $P_1$ and $P_2$. Once the two polish rates have been determined, it is a simple matter to determine the amount of wafer material removed based upon the amount of resistive sensor 205 removed. The important factor here is not the absolute polish rate of the resistor sensor, but its relative polish rate to that of the material to be monitored and controlled.

Figure 3:
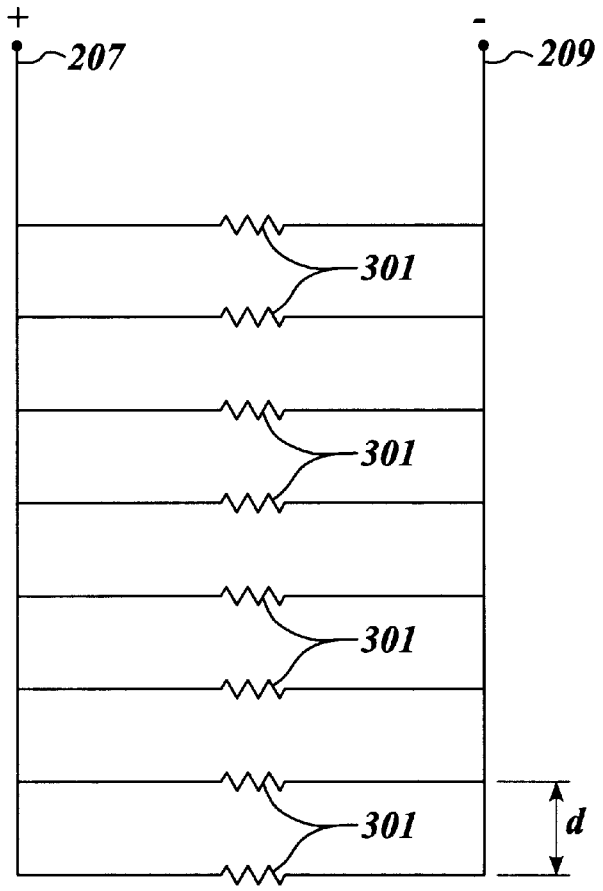
FIG. 3 is a schematic diagram of the resistive sensor formed in accordance with the present invention.

The resistive sensor 205 has two electrical leads extending therefrom: a positive lead 207 and a negative lead 209. These leads preferably extend out of body 201 and through wafer chuck 101 to outside processing means. The leads, as shown in the electrical schematic of the resistive sensor 205 in FIG. 3, are attached to the two respective ends of resistor elements 301. Thus, the resistor elements 301 are in parallel to each other. Further, the resistor elements are uniformly spaced apart by a distance d, which in the preferred embodiment is 0.3 microns, although this could be made smaller to increase resolution of the endpoint detection.

The resistive sensor 205 is preferably formed on a silicon substrate with prior art thin film polysilicon resistors. Specifically, resistor arrays like those commonly used in the magnetic heads of disk drives may be used, as appropriately modified, as the resistive sensor 205. For example, the magnetic head of a conventional disk drive apparatus includes an ordered array of copper resistors formed in an alumina substrate. These magnetic heads may be "sliced" into segments for use as the resistive sensor 205 with the appropriate modification for the attachment of electrical leads.

The resistor elements 301 have a resistance value that is dependent upon the length and width of the resistor element 301, as well as the resistivity of the thin film resistor, commonly known as $\rho$.

Alternatively, other mechanisms that provide a variable resistance as material is removed by polishing may be used. As is commonly known, the resistance of a material depends upon the length and width of the material. Thus, there are a multitude of materials are suitable for use as the resistive sensor. However, the use of discrete resistors is preferable because of the ability to easily monitor changes in resistance.

Figure 4:
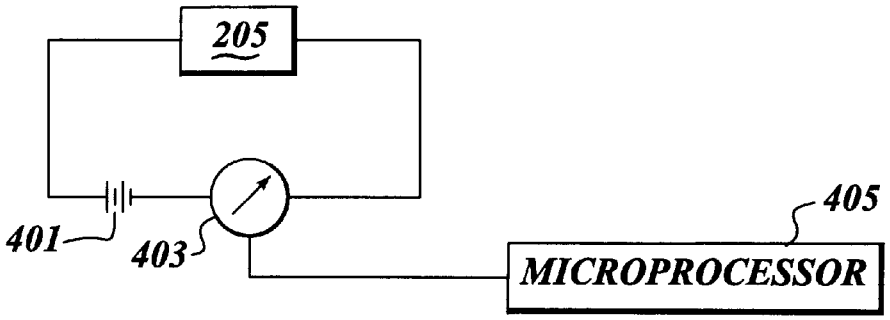
FIG. 4 is a schematic diagram of electrical circuit formed in accordance with the present invention.

In operation, turning to FIG. 4, a voltage source 401 applies a voltage to the leads 207 and 209 of the resistive sensor 205. The voltage is preferably on the order of 0.5 to 3 volts. The applied voltage causes a current to flow. A current detector 403 monitors the current output indicative of the amount of materials polished. In an alternative embodiment, a current source may be substituted for the voltage source 401 and a voltage detector may be substituted for the current detector 403.

The amount of current flowing as indicated by the current detector 403 is proportional and indicative of the amount of resistance provided by the resistive sensor 205. In particular, as the CMP process proceeds, the resistive sensor 205 will also be polished. As the resistive sensor 205 is polished, resistor elements 301 are broken and the overall amount of resistance presented by the resistive sensor 205 changes.

As an example, assume that the resistive sensor has nine resistor elements 305, each of which have a resistance of 5 ohms. Using well known relationships, the total resistance of the resistive sensor 205 is given by:

$$R_t=1/[\Sigma(1/R_i)]$$

Thus, for nine parallel resistors of 5 ohms each, the total resistance is 0.555 ohms. Assume further that the voltage source 401 provides a voltage of 1 volt. The resultant current measured by the current detector 403 would then be 1.8 amps.

If, however, during CMP processing, one of the resistor elements 301 is removed, then for eight parallel resistors of 5 ohms each, the total resistance is 0.625 ohms. The resultant sensed current would then be 1.6 amps. Thus, it can be seen that a relationship between current sensed and the number of resistor elements 301 that remain can easily be determined. In this example, the following chart (or look up table) may be used by the microprocessor 405 for a voltage source of 1.0 volts:

| No. | Resistance | Current |
|---|---|---|
| 9 | 0.55 | 1.8 |
| 8 | 0.625 | 1.6 |
| 7 | 0.71 | 1.4 |
| 6 | 0.83 | 1.2 |
| 5 | 1 | 1 |
| 4 | 1.25 | 0.8 |
| 3 | 1.67 | 0.6 |
| 2 | 2.5 | 0.4 |
| 1 | 5 | 0.2 |

From this look up table, the microprocessor can thus determine how many resistor elements 301 have been broken. For example, if the microprocessor receives a signal from the current detector 403 that a current of 0.8 amps is flowing, then the microprocessor can determine that 5 resistor elements 301 have been broken. Further, given the predetermined knowledge that each resistor element 301 occupies 0.3 microns, the microprocessor may determine that 1.5 microns of material have been removed from the resistive sensor 205. This also leads to the conclusion that 1.5 microns of material have been removed from the wafer being polished.

Figure 5:
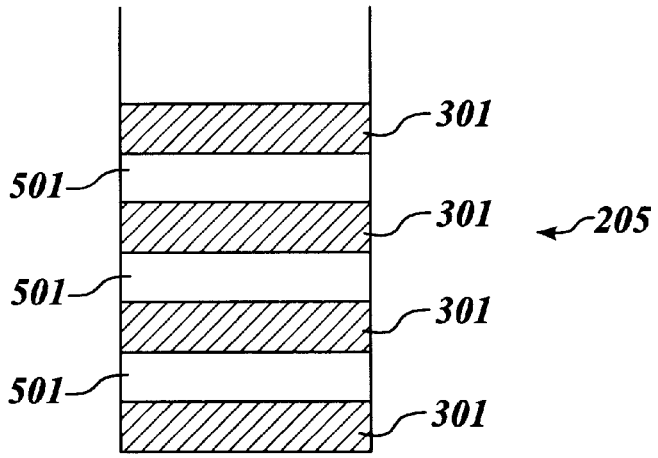
FIG. 5 is a detailed view of a resistive sensor formed from a resistive array.

It should be noted that the resistive sensor 205, if it is a resistor array like those commonly used in the magnetic heads of disk drives, will include alternating resistive portions and "blank portions" (sections of alumina substrate). Specifically, referring to FIG. 5, the resistive sensor 205 includes resistor elements 301 and blank portions 501. The blank portions 501 are typically non conductive and serve to separate the resistor elements 301 into discrete elements. Because of this, the resistive sensor 205 will have a loss of "resistive resolution". In other words, the resistance of the resistive sensor 205 will remain the same as the blank portions 501 are polished, even though polishing is taking place.

Figure 6:
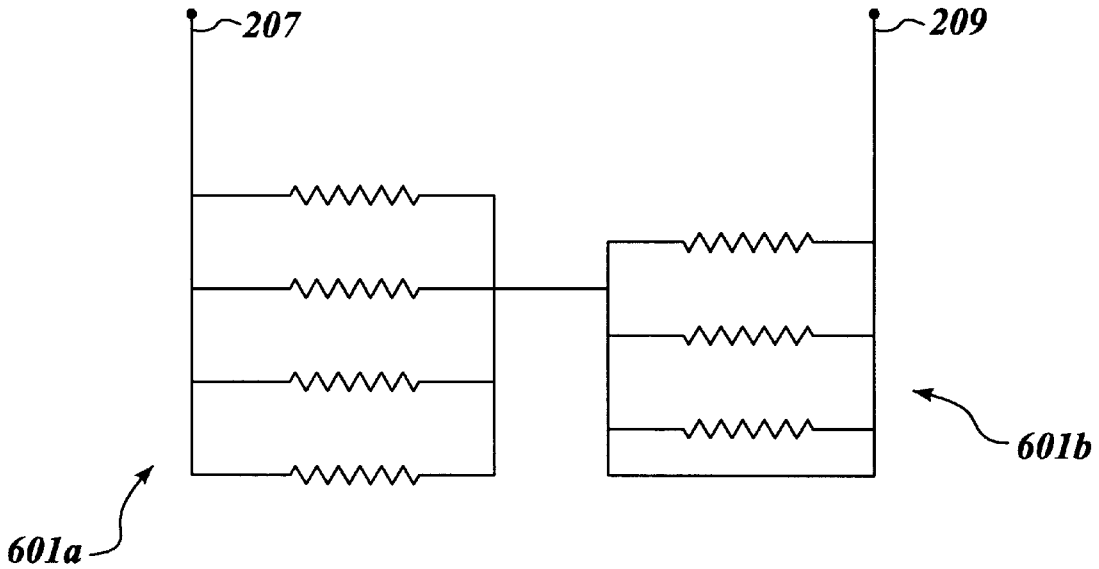
FIG. 6 is a schematic diagram of an alternative embodiment of the resistive sensor.

In order to solve this problem, an alternative embodiment of the resistive sensor 205 is shown in FIG. 6. In this embodiment, two separate resistive arrays 601*a* and 601*b* are placed in series between the leads 207 and 209. However, they are arranged such that the blank portion of one resistive array is aligned with the resistor element of the other resistive array. Thus, while a blank portion of one resistive array is being polished, a resistor element of the other resistive array is being polished (and broken). In this manner, increased resolution of the current flow is possible.

After it is determined the amount of material of the resistive sensor that has been removed, this information can be used to control the CMP process. For example, the amount of material removed may be compared to a predetermined threshold, and if the amount of material removed exceeds the predetermined threshold, the CMP process may be terminated. If the amount of material removed does not exceed the predetermined threshold, the CMP process may continue. In this manner, the method of the present invention may be used to precisely control the CMP process.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A chemical mechanical polisher for polishing a surface of a semiconductor wafer, the chemical mechanical polisher comprising:

a polishing table for holding a polishing pad;

a rotatable wafer chuck for holding said semiconductor wafer against said polishing pad;

an electrical lapping guide secured to said wafer chuck, said electrical lapping guide comprising:

a polishable resistive sensor that has a variable resistance dependent upon the amount of material removed from said resistive sensor during polishing; and a bias means for applying a bias to said resistive sensor such that said resistive sensor is in contact with said polishing pad during polishing; and a resistance sensing means for determining said variable resistance of said resistive sensor.

2. The apparatus of claim 1, further including a microprocessor for determining the amount of material polished from said resistive sensor based upon said variable resistance.

3. The apparatus of claim 1, wherein said resistance sensing means comprises:

a voltage source for applying a voltage to said resistive sensor;

a current detector for detecting a current flow rate that is indicative of the amount of current flowing through said resistive sensor.

4. The apparatus of claim 1, wherein said resistance sensing means comprises:

a current source for applying a current to said resistive sensor;

a voltage detector for detecting a voltage that is indicative of the voltage across said resistive sensor.

5. The apparatus of claim 1 wherein a plurality of electrical lapping guides are attached to said wafer chuck.

6. The apparatus of claim 1 wherein said bias means is a spring.

7. The apparatus of claim 1 wherein said bias means is operative to provide an adjustable bias to said resistive sensor.

8. The apparatus of claim 1 wherein said resistive sensor is an array of resistors connected in parallel.

9. The apparatus of claim 8 wherein said array of resistors are formed from thin film polysilicon on a semiconductor substrate.

10. The apparatus of claim 1 wherein said resistive sensor includes at least two arrays of resistors, each array of resistors connected in parallel and formed from alternating blank portions and resistor elements, said at least two arrays of resistors connected in series and having their blank portions and resistor elements offset from each other.

11. A method of determining the amount of material removed from a semiconductor wafer during a polishing by a chemical mechanical polisher, said polisher including a polishing table for holding a polishing pad and a rotatable wafer chuck for holding said semiconductor wafer against said polishing pad, the method comprising the steps of:

securing an electrical lapping guide to said wafer chuck, said electrical lapping guide comprising:

a polishable resistive sensor that has a variable resistance dependent upon the amount of material removed from said resistive sensor during polishing; and a bias means for applying a bias to said resistive sensor such that said resistive sensor is in contact with said polishing pad during polishing;

determining said variable resistance of said resistive sensor; and determining the amount of material polished from said resistive sensor based upon said variable resistance.

12. The method of claim 11 further including the step of stopping said polishing when the amount of material polished from said resistive sensor reaches a predetermined threshold.

13. The method of claim 11 wherein said step of determining said variable resistance comprises:

applying a voltage to said resistive sensor;

detecting a current flow rate that is indicative of the amount of current flowing through said resistive sensor; and determining said variable resistance as said voltage divided by said current flow rate.

14. The method of claim 11, wherein said step of determining said variable resistance comprises:

applying a current to said resistive sensor;

detecting a voltage that is indicative of the voltage across said resistive sensor; and determining said variable resistance as said voltage divided by said current.

15. A chemical mechanical polisher for polishing a surface of a semiconductor wafer, the chemical mechanical polisher comprising:

a polishing table for holding a polishing pad;

a rotatable wafer chuck for holding said semiconductor wafer against said polishing pad;

an electrical lapping guide secured to said wafer chuck, said electrical lapping guide comprising:

a polishable resistive sensor that has a variable resistance dependent upon the amount of material removed from said resistive sensor during polishing; and a bias means for applying a bias to said resistive sensor such that said resistive sensor is in contact with said polishing pad during polishing;

a voltage source for applying a voltage to said resistive sensor; and a current detector for detecting a current flow rate that is indicative of the amount of current flowing through said resistive sensor.

16. The apparatus of claim 15 further including a microprocessor for determining the amount of material polished from said resistive sensor based upon said current flow rate.

17. The apparatus of claim 15 wherein a plurality of electrical lapping guides are attached to said wafer chuck.

18. The apparatus of claim 15 wherein said bias means is a spring.

19. The apparatus of claim 15 wherein said bias means is operative to provide an adjustable bias to said resistive sensor.

20. The apparatus of claim 15 wherein said resistive sensor is an array of resistors connected in parallel.

21. The apparatus of claim 15 wherein said resistive sensor includes at least two arrays of resistors, each array of resistors connected in parallel and formed from alternating blank portions and resistor elements, said at least two arrays of resistors connected in series and having their blank portions and resistor elements offset from each other.

* * * * *